United States Patent [19]

Catalano

[11] 4,139,136

[45] Feb. 13, 1979

[54] NAIL DRIVER

[76] Inventor: Joseph R. Catalano, 695 Liberty St., Rockland, Mass. 02370

[21] Appl. No.: 818,830

[22] Filed: Jul. 25, 1977

[51] Int. Cl.[2] ..... B25C 1/02

[52] U.S. Cl. ..... 227/109; 227/78; 227/147

[58] Field of Search ..... 227/78, 109, 120, 129, 227/147

[56] References Cited

U.S. PATENT DOCUMENTS

| | | | |
|---|---|---|---|
| 2,438,361 | 3/1948 | Doblin et al. | 227/109 |
| 3,007,171 | 11/1961 | Critchley | 227/109 |
| 3,012,247 | 12/1961 | Sillars et al. | 227/147 |
| 3,979,040 | 9/1976 | Denin | 227/147 |

*Primary Examiner*—Howard N. Goldberg
*Assistant Examiner*—Paul A. Bell
*Attorney, Agent, or Firm*—Wolf, Greenfield & Sacks

[57] ABSTRACT

A nail driver having a rod that telescopes within a hollow elongated tube. One end of the rod is designed to strike the nails and a weighted handle is attached to the other end. The tube has at least one chamber for holding the nails in position to be struck by the driver, and the chamber has a slot for receiving the nails. There are means for feeding nails through the slot. Preferably there are two such chambers and two such feeding means, one chamber and feeding means adapted for flat headed nails and the other chamber and means adapted for finishing nails. The impacting end of the rod is bifurcated, and one portion is designed to drive finishing nails in one chamber and the other portion is designed to drive flat headed nails in the other chamber. The impacting end of the rod and the chamber are changeable so that the invention may be used to drive a wide variety of nail sizes and types.

5 Claims, 7 Drawing Figures

NAIL DRIVER

BACKGROUND OF THE INVENTION

The invention in general relates to fastener driving tools, and more particularly relates to a manual nail driver having a manually actuated mechanical nail feed mechanism.

Manual nail driving tools, such as hammers, are commonly used to drive nails whenever the nail driving operation is not identically repetitive, for example, in the home workshop and in the building and cabinet work trades. The common hammer is an effective and highly portable tool whenever there is sufficient space about the nail in which to swing the hammer. However, often nails must be driven in a relatively confined area where the natural arc of the hammer must be interrupted, as for example between studs, building frameworks, within boxes, etc. In such confined areas driving nails is at least awkward and sometimes impossible. Further, in many confined areas it is difficult if not impossible to hold the nail in place while starting to drive it. Thus a manual nail driver that can be manipulated in relatively confined areas, and which mechanically feeds and holds the nail in proper position for driving is highly desirable.

The functional design of manual nail drivers is well developed and includes many United States patents. One such relevant United States patent is No. 3,901,298.

SUMMARY OF THE INVENTION

An important object of the invention is to provide a manual nail driver that may be manipulated in relatively confined areas.

A further object of this invention is to provide the above object in a nail driver in which the nails are mechanically fed and placed in the proper position for driving.

Another object of the invention is to provide the above objects in a nail driver that can drive a variety of types and sizes of nails, and in which both flat head and finishing nails may be driven in a single tool.

The invention provides a hollow, elongated tube for receiving and holding nails and a rigid rod which telescopes within the tube. One end of the rod is adapted for impacting the nails, and a weighted handle is attached to the other end. The tube has at least one chamber having an internal diameter large enough to receive the head and body of the nails to be driven but small enough to maintain the nails in alignment along the axis of the tube. Each chamber has at least one slot in the chamber wall for receiving the nails, the slot being parallel to the axis of the chamber. Preferably there are two such chambers and two such slots, one slot and chamber adapted to receive flat head nails and the other slot adapted to receive finishing nails. There is also at least one means for feeding nails through the slots and into the chambers. Preferably there are two such means, one for feeding flat head nails into the flat head nail chamber, and one for feeding finishing nails into the finishing nail chamber.

Numerous other features, objects and advantages of the invention will be better understood and appreciated from the following detailed description when read in conjunction with the accompanying drawing in which:

DESCRIPTION OF THE PREFERRED EMBODIMENT

Figure 1:
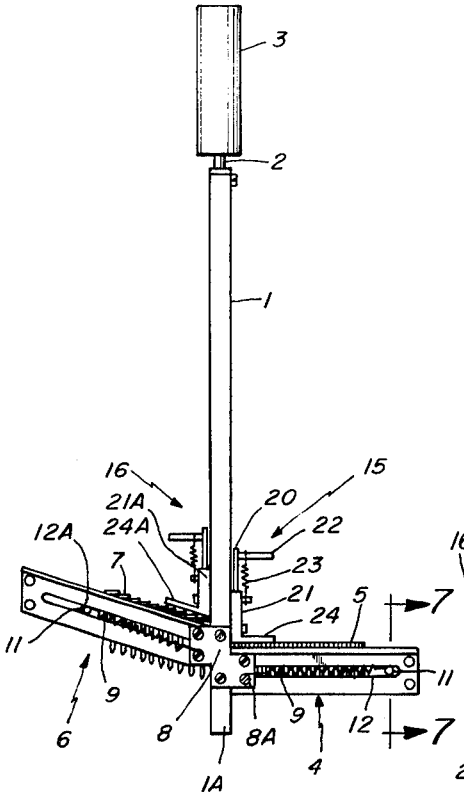
FIG. 1 is a front elevation view of the preferred embodiment of a nailer according to the invention.

The nail driver shown in the drawing includes a hollow, elongated frame 1 and a rod 2 which is movable within the frame. A weighted handle 3 is attached to the upper end of rod 2. A first magazine 4 holding a supply of finishing nails 5 and a second magazine 6 holding a supply of flat head nails 7 are secured by a bracket 8 to frame 1 by means of screws as suggested at 8A. Springs 9 acting between bracket 8 and fastener followers 11 urge the nails 5 and 7 in the magazines toward frame 1. Mechanisms for releasing single nails from the magazines 4 and 6 are indicated generally at 15 and 16 respectively. The release mechanisms 15 and 16 each include a pin 20A, 20B which slides in a guide 21, 21A and has a trigger 22 attached to its upper end. A release mechanism spring 23 acts between guide 21, 21A and trigger 22 to urge pin 20 downwardly toward the respective magazines 4 and 6. The lower legs 24 and 24A of guides 21 and 21A respectively serve to guide the head end of nails 5 and 7 respectively to the proper position for release.

In the embodiment shown the rod 2 consists of single upper rod section 2A and a changeable lower portion indicated generally at 30. Rod 2 slides in bushing 27 which is attached to the upper end of frame 1 by means of screw 28. Lower portion 30 comprises a central flat head nail driving tip 31 and an offset finishing nail driving tip 32. The finishing nail driving tip 32 is integrally formed with sliding collar 33 and is secured to the end of rod section 2A by means of screw 34. Flat head nail driving tip 31 fits into the socket in the lower end of collar 33, butts against the lower end of rod section 2A, and is held in place by a set screw (not shown).

Figure 6:
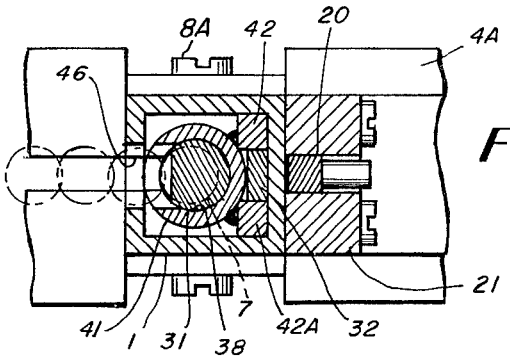

Nail driving chambers 38 and 39 are formed in the lower end of frame 1. The central flat head nail chamber 38 is preferably formed by a circular tube 41. The finishing nail driving chamber 39 is formed by a portion of the outer wall of tube 41, a portion of the inner wall of frame 1 and rectangular rods 42 and 42A (FIG. 6) which fit between the corners of frame 1 and tube 41. A set screw (not shown) retains tube 41 in the end of frame 1.

Figure 7:
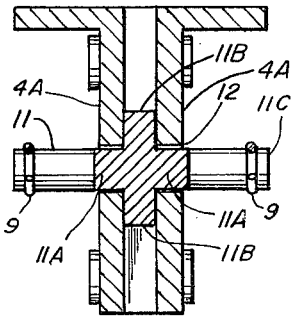
FIG. 7 is a cross-sectional view of the invention taken along section-line 7—7 of FIG. 1.

Finishing nails 5 enter chamber 39 through slot 45 in the wall of frame 1. Flat head nail 7 enters tube 41 through slot 46 which penetrates through both frame 1 and tube 41. Within the magazine 4 finishing nails 5 are held together in a clip 5A formed by coating a row of nails with a layer of adhesive 50. In magazine 6 flat head nails 7 are held together in a clip 7A formed by inserting a row of nails in plastic webbing 51. The nail clips are urged towards their respective slots by followers 11 which slide in guide slots 12, 12A in the magazines. A detail of one of followers 11 is shown in FIG. 7. Arms 11A of the follower fit in slots 12 and arms 11B fit between walls 4A of magazine 4. Pins 11C retain the ends of springs 9 which urge the follower toward frame 1.

Figure 2:
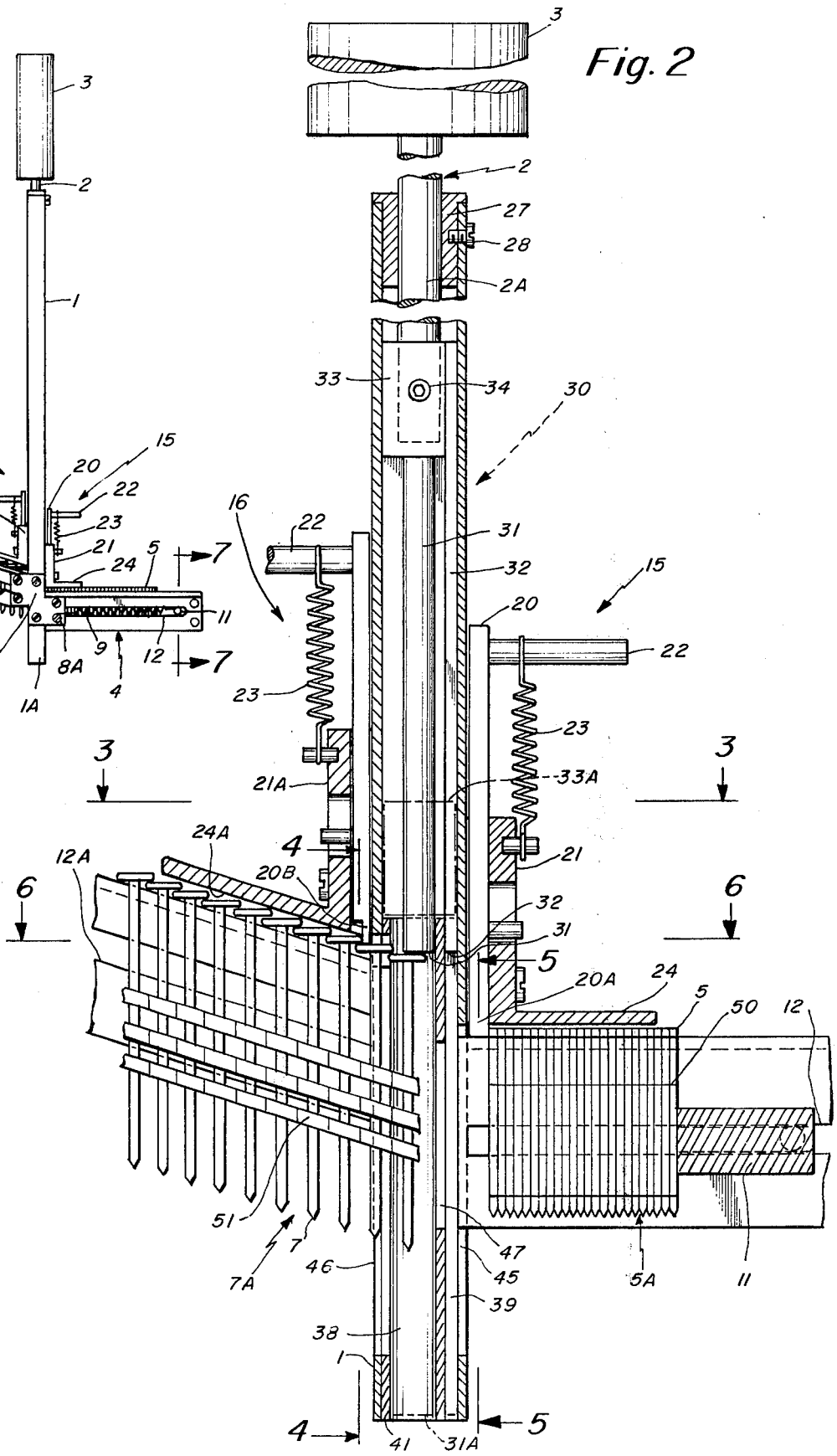
FIG. 2 is a fragmentary cross-sectional view of the nailer taken through the center of the device and parallel to the plane of the drawing of FIG. 1.
Figure 3:
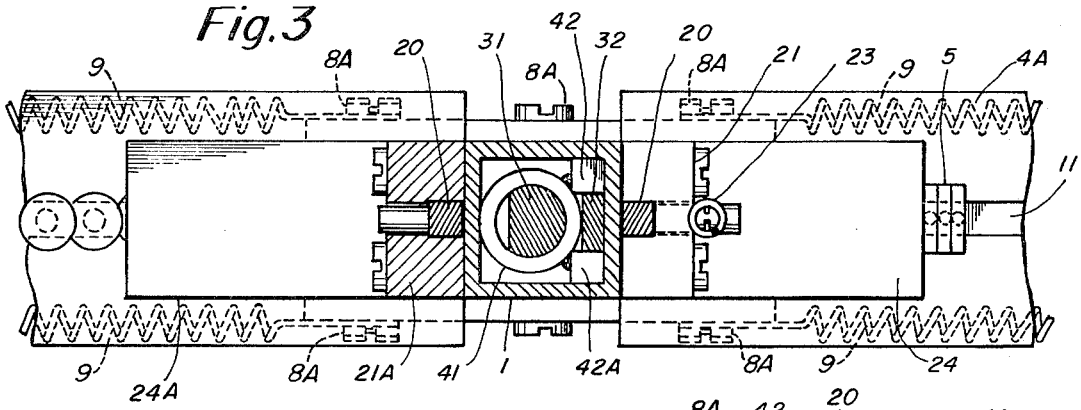
FIGS. 3-6 are cross-sectional views of the nailer taken along section-lines 3—3, 4—4, 5—5 and 6—6 of FIG. 2 respectively.

FIG. 2 shows in cross-section the details of release mechanisms 15 and 16. They are essentially identical except that tip 20B of release mechanism 16 is indented while tip 20A of mechanism 15 is blunt. Also, leg 24 of guide 21 is horizontal while leg 24A of guide 21A is angled upwardly.

Two alternative methods of feeding nails one at a time into the drive chambers are shown, one being employed for the finishing nails and the other for the flat head nails. In the method employed with the finishing nails, the nails 5 are aligned in a row with their heads forming a straight line. When a clip 5A of nails is inserted in magazine 4 in front of plunger 11 the plunger pushes them towards slot 45. However, before reaching the slot the top of the nail nearest the slot is engaged by the end of pin 20 which is held thereagainst by spring 23. When pin 20 is raised by means of trigger 22 nail clip 5A moves to the left as viewed in FIG. 2 and the first nail enters chamber 39. When pin 20 is released it engages the nails directly beneath it thereby preventing the clip 5A from moving in the direction of chamber 39 while the nail pushed in the chamber is being driven.

In the embodiment of the nail injection mechanism employed for the flat head nails, the nails are spaced by the plastic webbing 51 so that the bottom surface of the head of the nail engages the top surface of the nail inserted into the webbing immediately preceding it. Thus the nails are stepped downwardly to the right in FIG. 2 and form an angle to the horizontal. The nails are inserted into the magazine 6 so that the clip 7A angles downward toward the slot 46. As in the embodiment described above nail clip 7A is urged toward slot 46 by the follower. When the pin is raised, the first of the nails 7 enters chamber 38. When the pin is released tip 20B comes to rest against the top of the nail directly beneath it, and intercepts the head of the nail directly to the left of it as viewed in the drawing, thus preventing the nails in the clip from entering chamber 38 while the nail within the chamber is being driven.

The driving rod 31 is preferably in the form of a three quarter circle in cross-section which does not intersect the border portion of the arc of chamber 38 that is nearest slot 46 so that as it drives the nail in chamber 38 it avoids contacting the portion of the head of the next nail which may project into the chamber. In both embodiments of the nail injection mechanism a portion of the plastic adhesive 50 or webbing 51 is ripped away from a nail clip each time a nail is driven. Slot 47 in the wall of tube 41 permits the plastic to pass from the chamber that is being used into the chamber that is not being used. It may then be discharged by the driving tip in that chamber, thereby preventing the jamming of the chambers by the shredded plastic.

Figure 4:
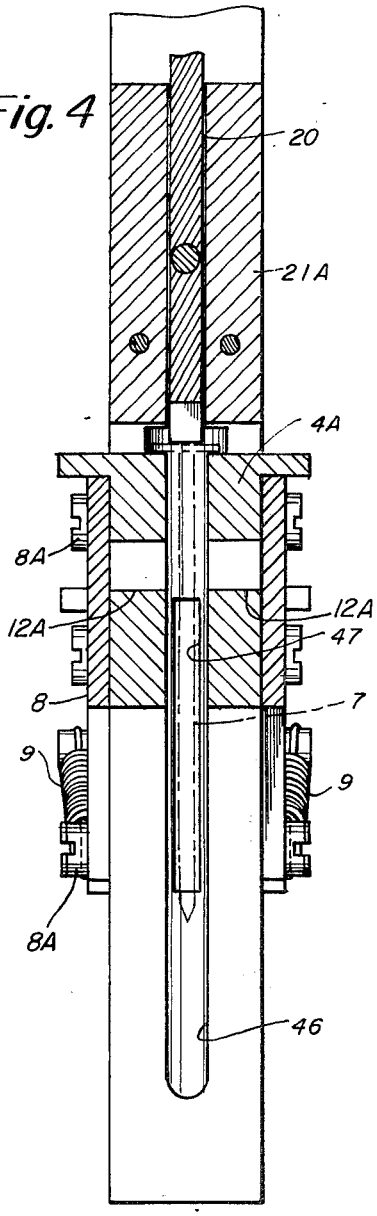
Figure 5:
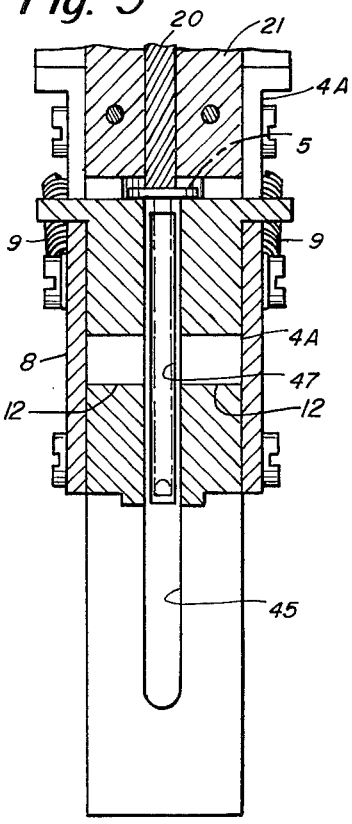

The nail driver is operated by first inserting nails into one or both of magazines 4 and 6 by pulling the follower 11 toward the end of the magazine and away from frame 1, dropping the nails between the follower and the frame, and then releasing the follower. Then the end 1A of frame 1 is placed against the object into which the nail is to be driven, a nail is released into the appropriate one of the chambers 38 and 39 by raising one of the triggers 22 and then handle 3 is reciprocated thereby impacting rod 2 against the nail and driving it into the object. The weight 3 on the end of rod 2 obviously assists in driving the nail. The invention is illustrated as being loaded with both finishing nails and flat head nails, and with a flat head nail inserted into chamber 38 in a position ready to be driven. The lowermost position of driving tip 31, that it would assume when the nail is completely driven into the work is shown in phantom at 31A. In FIG. 4 a nail 7 is shown in phantom to indicate the relationships of the various parts of the assembly when a nail is to be driven into the work.

The invention may be formed of any suitable metal, such as aluminum, steel, etc. or any suitable hard plastic. Preferably the handle 3 is formed of heavy metal such as iron or steel. Preferably bushing 27 and collar 33, rod 2, driving tips 31 and 32, tube 41, and rods 42 and 42A are formed of hardened steel.

In the embodiment shown the overall height of the driver from the lower end of frame 1 to the upper end of handle 3 is approximately 26 inches. Tube 41 has an internal diameter of $\frac{3}{8}$ inches and chamber 39 has dimensions of approximately $\frac{1}{8}$ inch by $\frac{1}{4}$ inch. With such dimensions the invention is suitable for driving finishing nails within the range of approximately No. 60 to 80, and flat head nails in a range of No. 80 to 100. Other ranges of nail sizes may be driven by suitably altering the dimensions of the invention.

An important advantage of the invention is that it may be used to drive nails in situations in which it is difficult or impossible to drive nails with a hammer. In framing buildings or other structures it is often necessary to drive nails between studs or low railings where there is no room to swing a hammer. In other situations, although a hammer may be used, it is necessary to assume extremely awkward body positions. In all of these situations the invention may be used with ease. A further feature of the invention is that in many situations it is difficult or impossible to hold the nail with one hand while driving it with a hammer. This of course is never a problem when using the present invention.

The invention also has application in situations where a conventional hammer may be used. The manually actuated mechanical nail feed feature of the invention is highly reliable and does away with fumbling for nails, and the bending or removing of misstruck nails. Thus the invention affords considerable savings in time and materials. Another important advantage of the invention is that it makes the driving of nails easier for unskilled persons, and persons that have visual difficulties, and others who find it difficult to accurately strike the head of a nail with a hammer.

The interchangeable driving tip 30 and the double feed feature permits a wide variety of sizes and styles of nails to be driven. In addition tube 41 may be easily removed and replaced by a tube of different dimensions so that it can accommodate almost any size or style of nail. The driving tip may be adapted to drive nails flush or to counter sink them by adjusting the length of tips 31 and 32. Thus almost any conceivable nailing task may be handled with the invention.

There has been described a novel nail driving apparatus which permits the quick and efficient driving of nails in many cases when it is difficult or impossible to drive nails with a hammer, which is relatively independent of the skill of the operator, and which has numerous other features. It is evident that those skilled in the art may now make numerous uses and modifications of and departures from the specific embodiment described herein without departing from the inventive concepts. For example, the length of magazine 4 and 6 and/or the length of frame 1 and rod 2 may be considerably shortened to provide an embodiment of the invention that can be used in closer confines, although the former reduces the storage capability and the latter increases the number of blows that may be required to drive a nail by a person of a given strength. Likewise there are many variations of the nail feed and release mechanisms that comes within the inventive concept. Consequently the invention is to be construed as embracing each and every novel feature and novel combination of the features present and possessed by the nail driver herein described.

What is claimed is:

1. A nail driver comprising a hollow elongated tube having at least one chamber for receiving and holding a nail, a slot formed in the chamber wall parallel to the axis of the chamber for introducing nails into the chamber, a driving rod movable along the axis of said tube and having an impacting end adapted to drive the nail, a weighted handle secured to the end of said rod opposite the impacting end, means independent of the position of said driving rod for mechanically feeding nails into said chamber said means for feeding nails including:

at least one spring-loaded magazine adapted for holding a nail clip, and a means for releasing one nail at a time from said magazine through said slot into said chamber.

2. A nail driver in accordance with claim 1 wherein:

there are two of said chambers and separate means for feeding two different kinds of nails and two magazines, said impacting end of said rod is bifurcated, with one arm adapted to drive a nail in one chamber and the other arm adapted to drive a nail in the other of the chambers.

3. A nail driver in accordance with claim 2 wherein said impacting end of said rod is removable to enable other impacting ends to be mounted on the rod.

4. A nail driver comprising:

a hollow elongated tube having two chambers for receiving a nail, a driving rod movable along the axis of said tube and having a bifurcated impacting end, a weighted handle secured to the end of said rod opposite the impacting end, said chambers each having a slot formed in the chamber wall parallel to the axis of the chamber for introducing nails in the chamber, means for feeding nails including:

two magazines having spring-pressed followers mounted on said tube for receiving clips of two different kinds of nails, separate means for releasing one nail at a time from each of said magazines into its adjoining chamber through its respective slot, said bifurcated impacting end of said rod having one arm adapted to drive a nail in one chamber, and the other arm adapted to drive a nail in the other of the chambers, one of said chambers having a larger cross-section than the other, the impacting ends of the arms of the rod being of different cross-section and corresponding to the cross-sections of the chambers.

5. A nail driver in accordance with claim 4 wherein said releasing means includes a manually operable actuating means.

* * * * *